US005834665A

United States Patent [19]

Hanns et al.

[11] Patent Number: 5,834,665

[45] Date of Patent: Nov. 10, 1998

[54] GUITAR BRIDGE BIAS CONVERTER

[76] Inventors: Mark Jefferson Hanns, 6A Ashburnham Road, London, SW10 OPQ; James Stevenson, 25C, Trebonr Road, London SW5 9NF, both of United Kingdom

[21] Appl. No.: 767,331

[22] Filed: Dec. 16, 1996

[51] Int. Cl.[6] ..... G10D 3/04

[52] U.S. Cl. ..... 84/298; 84/307

[58] Field of Search ..... 84/298, 299, 307

[56] References Cited

U.S. PATENT DOCUMENTS

| | | | |
|---|---|---|---|
| D. 269,438 | 6/1983 | Peavey | D17/21 |
| 3,605,545 | 9/1971 | Rendell | 84/299 |
| 4,016,793 | 4/1977 | Kasha | 84/307 |
| 4,538,498 | 9/1985 | Marten | 84/298 |
| 5,052,260 | 10/1991 | Cipriani | 84/298 |
| 5,208,410 | 5/1993 | Foley | 84/307 |
| 5,271,307 | 12/1993 | Pollock | 84/298 |

*Primary Examiner*—William M. Shoop, Jr.
*Assistant Examiner*—Shih-Yung Hsieh

[57] ABSTRACT

A guitar bridge bias converter is described which provides the means of converting a right-handed steel strung electric or acoustic guitar to a left-handed instrument. The bridge bias converter for an acoustic guitar consists most simply of an integral one-piece unit comprising a central plate, a lower tongue, and an upper bridge-bone. The tongue locates in the groove vacated by removal of the original right-handed bridge-bone. The plate sits on top of the bridge and the bridge-bone is situated on the plate at an angle which is diametrically opposed to the original bridge-bone. This has the effect, in conjunction with reversal of the string positions, of converting the guitar from right-handed to left-handed playing. An alternative embodiment appropriate to conversion of electric guitars is also described, comprising a replacement bridge block incorporating mounting hole protrusions so offset as to convert the instrument from right-hand to left-handed string bias. It is an important feature of the invention that it requires no change to the body of the instrument and that the conversion process is completely reversible.

1 Claim, 4 Drawing Sheets

GUITAR BRIDGE BIAS CONVERTER

This invention relates to guitars

BACKGROUND OF THE INVENTION

Fixed bridge guitars have a bridge-bone on which the strings sit which is not perpendicular to the direction of the strings. There is a bias angle incorporated so as to compensate for the extra tension generated by the heavier gauge and more highly tensioned bass register strings as the player exerts pressure on them when he plays further up the neck of the instrument. This bias angle effectively provides a marginal increase in open-fret string tuning length as the strings become deeper in tone and has the effect of ensuring that all the strings maintain true relative and absolute pitch at all fret positions. The intonation of the instrument thereby is held constant at all fret playing positions.

The above-mentioned bias angle is designed for correct intonation of the instrument when it is played by a right-handed player. If a left-handed player were to play the same guitar it would be necessary for it to be turned upside down and to reverse the order of the strings. However this results in the bridge-bias being diametrically opposed to that required for correct intonation and results in the instrument becoming increasingly out of tune as the musician plays further up the neck.

Left-handed guitars are uncommon and available in greatly more restricted variety than right-handed ones. Conversion of right-handed to left-handed playing involves irreversible modification and disfigurement of the instrument which reduces sound quality and instrument value. In consequence left-handed players are disadvantaged in choice and variety of instruments available to them.

SUMMARY OF THE INVENTION

The object of this invention is to provide means whereby a left-handed player can play any conventional right-handed guitar without the need for permanent modification of the instrument. The fitting of a device, the subject of this invention, to the instrument is simple, quick and convenient and is completely reversible.

According to the present invention there is provided a guitar bridge bias converter for converting conventional right-handed guitars to be playable by a left-handed player. This comprises a central plate, a tongue which locates into the existing bridge-bone rout or slot and a replacement bridge-bone on which the guitar strings rest. This replacement bridge-bone has an angle (measured with respect to a line perpendicular to the string direction) diametrically opposite to the angle of the original right-handed bridge-bone.

An alternative implementation of the invention, applicable particularly to electric guitars, similarly effects reversal of the intonation bias by means of replacing the bridge block with a bridge block of slightly different form. The normal bridge block sits on mounting pillars which locate into holes at either end of said bridge block. The replacement bridge block has protrusions at either end to accommodate the pillar locating holes and these locating holes are offset at twice the distance from the bridge block centre line that the bridge block pillars on the right-handed guitar are spaced from the centre line perpendicular to the strings.

This replacement bridge block when located over the locating pillars on the guitar thus exactly reverses the bias angle from a right-handed to a left-handed playing position thereby effecting bridge-bias conversion from right to left-handed playing.

This invention in its various embodiments thus provides means of effecting the conversion of a right-handed guitar to a left-handed guitar in a manner which is entirely reversible. The conversion requires no modification to and is in no way injurious to the body of the instrument.

BRIEF DESCRIPTION OF THE DRAWINGS

Specific embodiments of the invention will now be described by way of example with reference to the accompanying drawings in which.

DETAILED DESCRIPTION OF THE INVENTION

The right-handed guitar is converted from right to left-handed by means of the present invention in a simple manner. First the strings are detensioned and removed. The existing bridge-bone on acoustic guitars is most commonly freely located or lightly glued in a groove or slot cut into the fixed wooden bridge which secures the ends of the strings. This bridge-bone is removed by lifting or prising it from its groove and the bridge-bone bias converter is then simply located in the vacated slot or groove. This causes no damage to the instrument which can be reconverted to a right-handed guitar at any time by the removal of the bridge bias converter and replacement of the original bridge-bone.

Figure 1:
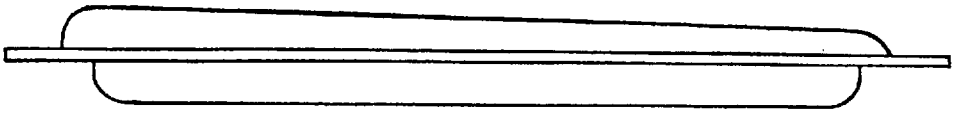
FIG. 1 shows the side elevation of the invention in its most simple form.
Figure 2:
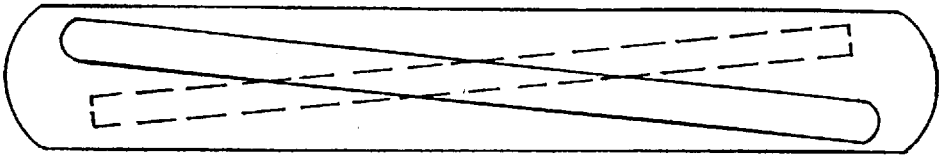
FIG. 2 shows the plan from above of the same.
Figure 3:
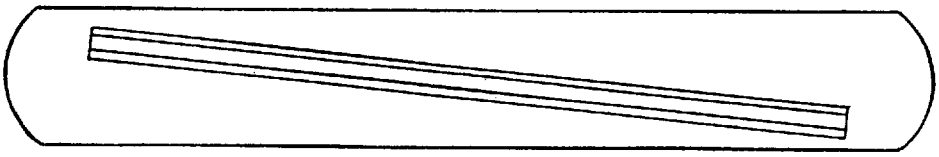
FIG. 3 shows the plan from below of the same.
Figure 4:
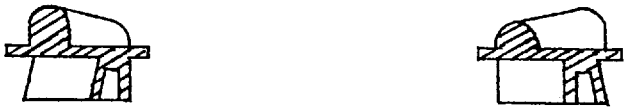
FIG. 4 shows sections of the same.
Figure 5:
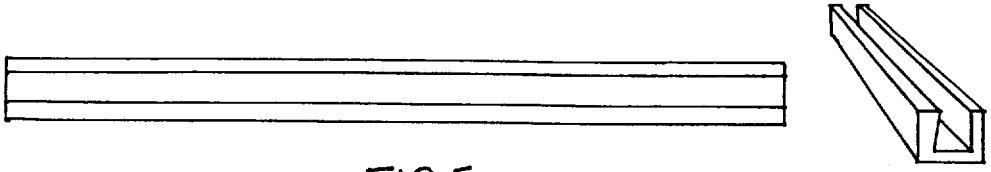
FIG. 5 illustrates a sleeve as employed in the tongue and sleeve method of varying the size of the locating tongue.

The invention though most simply provided in the form of an one-piece, integral bone plate and tongue, device as in FIGS. 1 to 4 may also be provided with means for varying the size of the locating tongue to accommodate different sizes of existing bridge-bone routs. This is achieved by a tongue which locates onto one of a small number of different sizes of sleeve as shown in FIG. 5.

Figure 6:
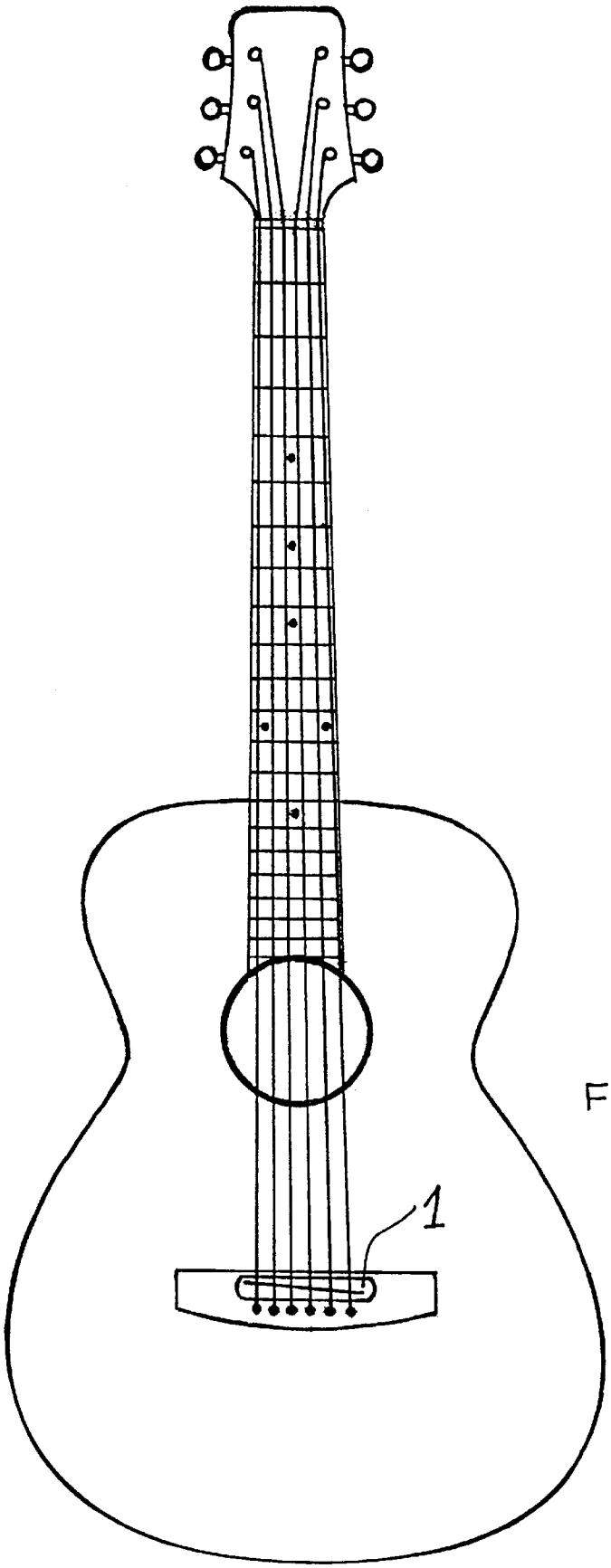
FIG. 6 shows the invention in place on an acoustic guitar bridge.
Figure 7:
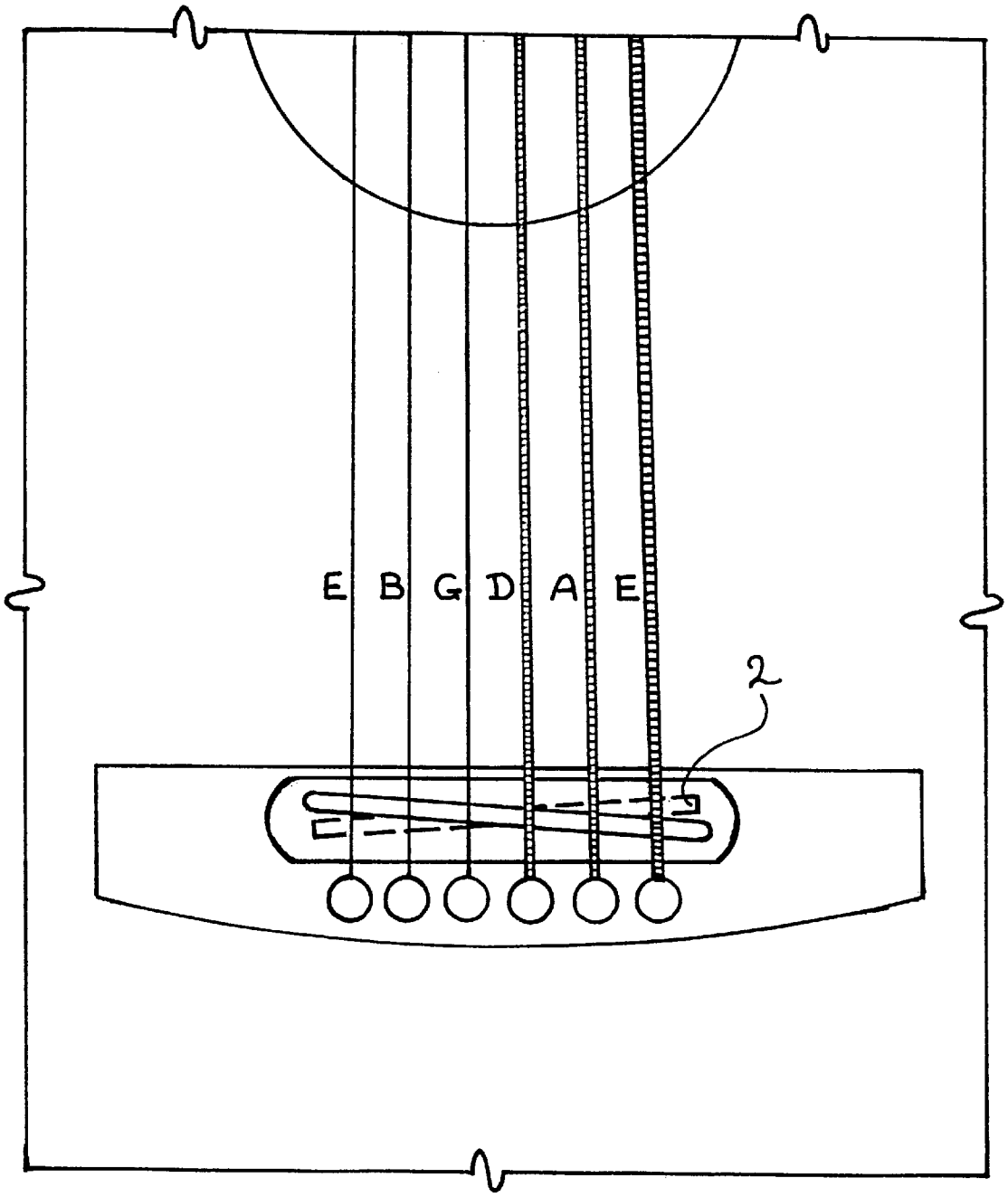
FIG. 7 is a detail of FIG. 6 showing the original right-handed bridge-bone position dotted and the strings mounted in reversed order appropriate for left-handed playing.

The bridge bias converter 1 is illustrated in situ in FIG. 6. FIG. 7 is an enlarged version of FIG. 6 showing the position of the existing rout 2 in broken outline.

Figure 8:
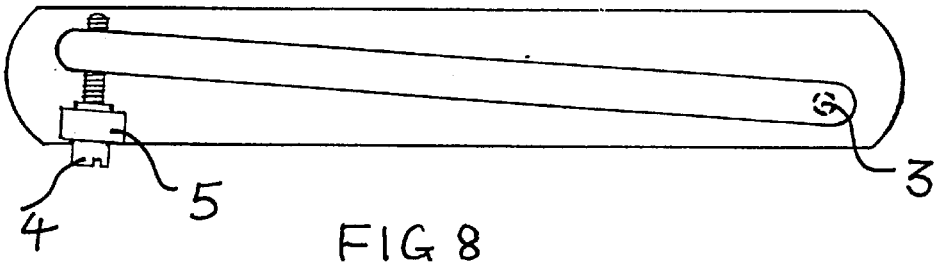
FIG. 8 shows a method of varying the bridge-bias by pivot and adjustment screw means.

When different string gauges are used on a guitar there may be requirement to make fine adjustment to the bias angle in order to adjust the intonation to achieve perfect tuning. Some embodiments of the invention incorporate a variable angle of bridge-bias to allow for such fine adjustment of the intonation. This variable angle can be achieved by various mechanical means. A typical example is shown in FIG. 8 whereby the bridge-bone may be varied in the angle of its position on a pivot 3 by a grub screw 4 which locates into a female screw thread 5.

Figure 9:
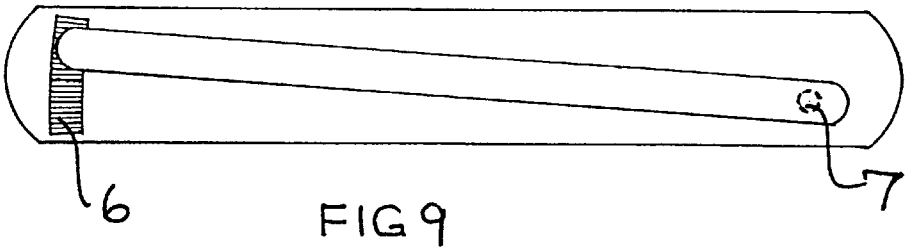
FIG. 9 shows a method of varying the bridge-bias by tooth and groove and locating track means.

FIG. 9 shows another example of an embodiment of intonation adjustment means whereby the bridge-bone is mounted to the plate by a pivot 7 and correct intonation is achieved by means of varying the bias angle by moving the position of the free end of the bridge-bone across a toothed locating track arrangement 6. The bridge-bone although superficially unsecured is held in place once the strings are in place and under tension, when the inherent downward pressure of the strings on the bridge-bone firmly maintains it in position.

Figure 10:
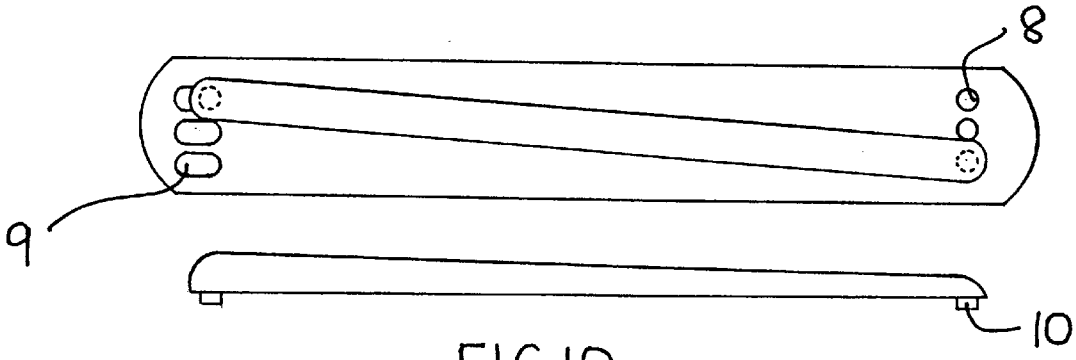
FIG. 10 shows methods of varying the intonation using a slot and tongue arrangement.

A further example of intonation adjustment is shown in FIG. 10 whereby the bias angle may be varied by means of a tongue and slot arrangement. Tongues on the bridge-bone 10 locate into holes 8 and/or slots 9 in the central plate. The bridge-bone is held firmly in place by downward pressure of tensioned strings as in the embodiment of FIG. 9.

Electric guitars commonly employ a different style of bridge whereby a bridge block assembly is mounted on pillars which are set at an angle to the line perpendicular to the strings. The appropriate and necessary bias angle of the bridge block to the strings is thereby achieved in accordance with the same principles as already explained as applying to achieving correct intonation of acoustic guitars.

Figure 11:
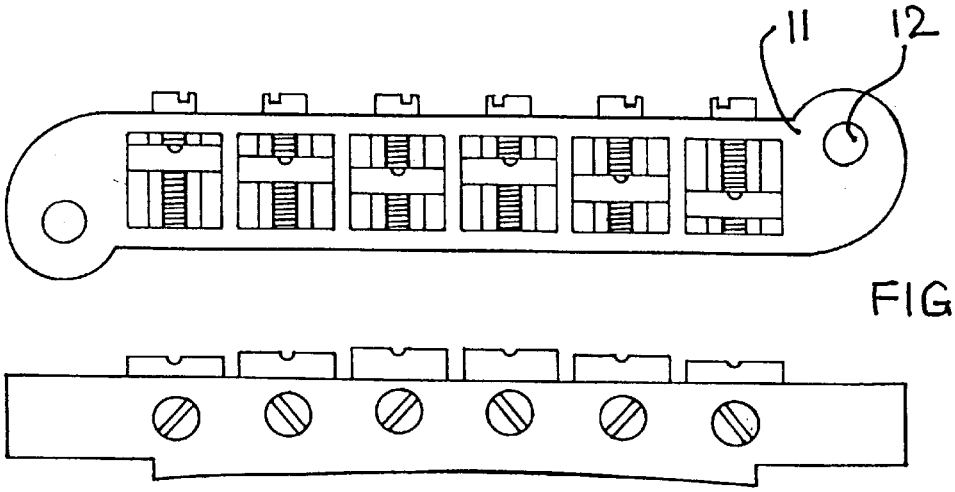
FIG. 11 shows the offset fixed-block type bridge as applicable to electric guitars with the protrusions containing the pillar locating holes at an appropriate spacing necessary to convert the intonation from right to left-handed.

FIG. 11 shows an embodiment of the invention applicable particularly to electric guitars which incorporates alternative bridge-bias angle conversion arrangements to accommodate the bridge mounting arrangements commonly found on electric guitars. In this embodiment the bridge comprises a main body 11 whose construction is similar to that for conventional right-handed bridge blocks, but the mounting holes 12 for the bridge block are located in protrusions on the main body of the bridge block and located at either end of the left-handed bridge block. These protrusions are such that the holes each have an offset which is equal to the total linear offset distance measured in the direction of the strings between the centres of the mounting pillars as constructed on the right-handed guitar. Placement of this particular type of bridge block effects bridge bias conversion from right to left-handed playing in a similar manner and providing the same benefits as applies to the embodiments as already described for acoustic guitars.

It should be noted that the total offset required on a bridge block embodiment of the bridge bias converter for electric guitars may be achieved by offsetting one of the holes only or the two holes by different amounts. It is preferable however in order to maintain correct and constant intonation, that both holes be offset equally. The total offset between the two holes introduces the appropriate compensation distance required for bias conversion from right to left-handedness. Typically this total bias distance is in the order of 4.5 mm for both electric and acoustic guitars.

We claim:

1. A bridge bias converter comprising: an elongated bone plate having a first end and a second end removably anchored in a slot for a bridge on a stringed musical instrument; said bone plate is anchored along a line perpendicular to a string direction; a straight elongated bridge bone having a first end and a second end; said first end of the bridge bone is pivotally anchored at said first end of said bone plate; and bias angle adjustment means attached to said second end of said bone plate to engage said second end of said bridge bone for adjusting a variable angle bridge bone with respect to said perpendicular line for the adjustment of the intonation.

* * * * *